United States Patent [19]

Imamura et al.

[11] Patent Number: 4,967,806

[45] Date of Patent: Nov. 6, 1990

[54] AUTOMATIC WEFT PICKING CONTROL SYSTEM FOR FLUID JET LOOM

[75] Inventors: Shuichiro Imamura; Shinji Wakai, both of Tokyo, Japan

[73] Assignee: Nissan Motor Co., Ltd., Yokohama, Japan

[21] Appl. No.: 359,799

[22] Filed: Jun. 1, 1989

[30] Foreign Application Priority Data

Apr. 5, 1989 [JP] Japan ..... 1-84678

[51] Int. Cl.[5] ..... D03D 47/30

[52] U.S. Cl. ..... 139/435.1; 139/435.2; 139/452

[58] Field of Search ..... 139/435, 452

[56] References Cited

U.S. PATENT DOCUMENTS

| | | | |
|---|---|---|---|
| 4,378,821 | 4/1983 | Umezawa | 139/452 |
| 4,550,753 | 11/1985 | Tsuji | 139/435 |
| 4,646,791 | 3/1987 | Tsuji et al. | 139/435 |
| 4,658,865 | 4/1987 | Gotoh | 139/435 |
| 4,673,004 | 6/1987 | Rosseel et al. | 139/435 |
| 4,766,937 | 8/1988 | Kojima et al. | 139/452 |
| 4,827,990 | 5/1989 | Takegawa | 139/435 |

FOREIGN PATENT DOCUMENTS

| | | | |
|---|---|---|---|
| 0279222 | 1/1988 | European Pat. Off. | 139/435 |
| 59-71459 | 4/1984 | Japan . | |
| 0044419 | 10/1984 | Japan | 139/435 |
| 2257441 | 11/1987 | Japan | 139/435 |
| 3012738 | 1/1988 | Japan | 139/435 |

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

A weft picking control system for accomplishing weft picking in a high response throughout a wide region of operating conditions of an air jet loom. The loom has a weft inserting nozzle which projects a weft yarn under the influence of air ejection therefrom. The weft picking control system has a first device for detecting a weft reaching timing at which the weft yarn projected from the weft inserting nozzle reaches a counter-weft picking side. A second device is provided to control an effective air ejection time for weft picking depending upon the air ejection of the weft inserting nozzle, in accordance with the detected weft reaching timing. The effective air ejection time is defined by at least one of a pawl disengagement timing (at which a weft retaining pawl is disengaged from a drum of a weft measuring and storing unit) and an air ejection termination timing (at which air ejection from the weft inserting nozzle is terminated). A third device is provided to compare at least one of the pawl disengagement timing and the air ejection termination timing with predetermined upper and lower limit values. Additionally, a fourth device is provided to change air pressure (under which the air ejection from the weft inserting nozzle is made) to be fed to the weft inserting nozzle when at least one of the pawl disengagement timing and the air ejection termination timing exceeds the predetermined upper and lower limit values.

16 Claims, 11 Drawing Sheets

AUTOMATIC WEFT PICKING CONTROL SYSTEM FOR FLUID JET LOOM

BACKGROUND OF THE INVENTION

1. Field of the Invention

This invention relates to improvements in a weft picking control system for a fluid jet loom, and more particularly to such a weft picking control system in which response in control is improved throughout a wide region of loom operating conditions.

2. Description of the Prior Art

Hitherto a variety of weft picking control systems for an air jet loom have been proposed and put into practical use in order to achieve an appropriate weft picking. One of them is disclosed in Japanese Pat. Provisional Publication No. 59-71459 and arranged as follows: In order to accomplish a weft picking by ejecting pressurized air from a weft inserting nozzle (main nozzle) for a predetermined time, the air pressure of the pressurized air to be supplied to the weft inserting nozzle is so controlled as to regulate at a predetermined target value a weft picking condition (for example, a timing of the weft yarn reaching a counter-weft picking side) for a picked weft yarn, thereby intending achievement of an appropriate weft picking regardless of kinds of yarns for the weft yarn.

However, difficulties have been encountered in such a conventional weft picking system of the type wherein air pressure fed to the weft inserting nozzle is controlled in response to the detected weft picking condition of the picked weft yarn, in which the pressure in a surge tank disposed upstream of the weft inserting nozzle is usually controlled to prevent turbulence of air upon sudden change in air pressure, thereby degrading response in control. Additionally, with such a control, there arise the following problems: When the air pressure excessively rises, a weft tension becomes too high at the termination period of weft picking, thereby causing breakage or cutting of the weft yarn. Besides, since the air pressure has an upper limit (or original pressure in a pressurized air source), there is a possibility of air pressure control becoming impossible.

SUMMARY OF THE INVENTION

It is an object of the present invention to provide an improved weft picking control system for a fluid jet loom, which can always accomplish an appropriate weft picking throughout a wide control region of loom operating conditions, while overcoming problems encountered in conventional weft picking systems.

Another object of the present invention is to provide an improved weft picking control system for a fluid jet loom, which improves response in a weft picking control by controlling a time in which fluid ejection is made from a weft inserting nozzle.

A first aspect of the present invention resides in a weft picking control system for a fluid jet loom including a weft inserting nozzle which is adapted to project a weft yarn under influence of fluid ejection therefrom. The system is comprised of a first device for detecting a weft picking condition of the weft yarn projected from the weft inserting nozzle. Additionally, a second device is provided to control a time for which the fluid ejection is made from the weft inserting nozzle, in accordance with the weft picking condition detected by the first device.

A second aspect of the present invention resides in a weft picking control system for a fluid jet loom including a weft inserting nozzle which is adapted to project a weft yarn under influence of fluid ejection therefrom. The weft picking control system is comprised of a first device for detecting a weft picking condition of the weft yarn projected from the weft inserting nozzle. A second device is provided to control an effective fluid ejection time for weft picking depending upon the fluid ejection of the weft inserting nozzle in response to the detected weft picking condition. The second device includes a third device for controlling at least one control parameter to define the effective fluid ejection time.

Meant by the above-mentioned "weft picking condition" of the weft yarn projected from the weft inserting nozzle is a weft reaching timing at which the weft yarn reaches a counter-weft picking side, a weft picking time from a weft picking initiation timing and the weft reaching timing (to the counter-weft picking side), a weft picking speed at the above-mentioned weft picking time, or the like.

Meant by the above-mentioned "effective fluid ejection time" for weft picking depending upon the fluid ejection from the weft inserting nozzle is a fluid ejection time which does not include a so-called previous fluid ejection time. The previous fluid ejection time is a time of fluid ejection (from the weft inserting nozzle) which ejection is started prior to the initiation of weft picking while restraining the weft yarn from projecting from the weft inserting nozzle until the initiation of weft picking under the action of a weft picking restraining member such as a weft grasping device and a weft retaining pawl engageable with a drum of a weft measuring and storing unit, thereby standing-ready the weft picking in a condition in which the leading end section of the weft yarn is straightened. It will be understood that the weft picking is initiated when the weft yarn is released from restraint by the weft picking restraining member.

Accordingly, in such a case, the effective fluid ejection time corresponds to a time from the weft picking initiation timing (at which the weft yarn is released from restraint by the restraining member) to the fluid ejection termination timing of the weft inserting nozzle. More specifically, the effective fluid ejection time is controlled by controlling the fluid ejection termination timing of the weft inserting nozzle and/or the weft picking initiation timing depending upon operation of the weft picking restraining member. It will be understood that, in case of controlling the weft picking initiation timing by the weft picking restraining member, it is preferable to simultaneously control the fluid ejection initiation timing of the weft inserting nozzle for the purpose of making the previous fluid ejection time constant.

Thus, according to the second aspect of the present invention, in the weft picking under the influence of fluid ejection from the weft inserting nozzle, the effective fluid ejection time (determined, for example, by the fluid ejection initiation and termination timings and the weft picking initiation timing by the weft picking restraining member) is controlled in response to the detected weft picking condition (for example, the weft reaching timing to the counter-weft picking side), thereby meeting a required weft picking condition. Using such a control of the effective fluid ejection time greatly improves response in control over the conventional control of fluid pressure to be fed to the weft inserting nozzle.

BRIEF DESCRIPTION OF THE DRAWINGS

In the drawings, like reference numerals designate like elements and parts throughout all figures, in which.

DETAILED DESCRIPTION OF THE INVENTION

Figure 1:
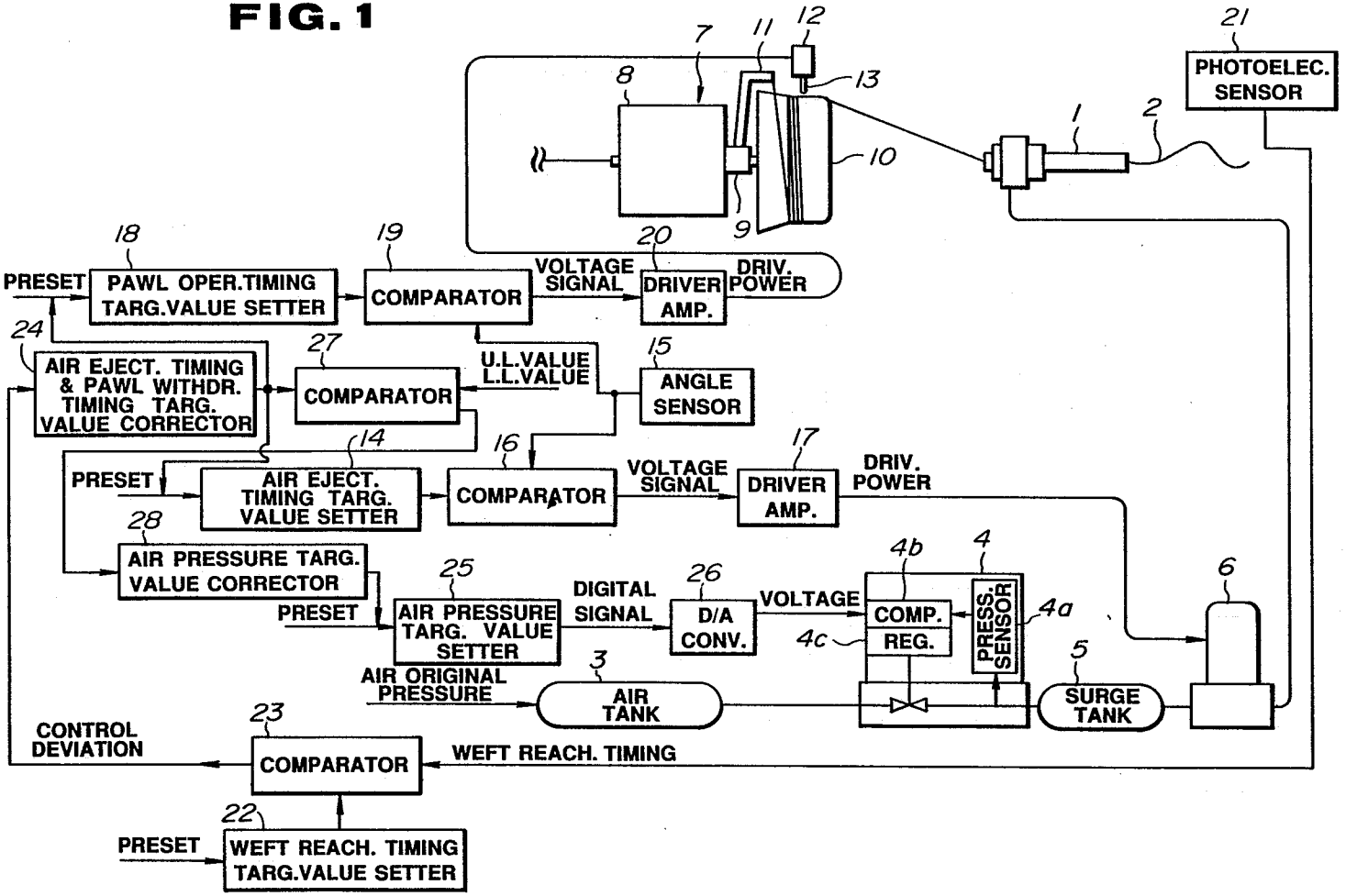
FIG. 1 is a diagrammatic illustration of a first embodiment of a weft picking control system in accordance with the present invention, incorporated with a weft picking system for a fluid jet loom.
Figure 2:
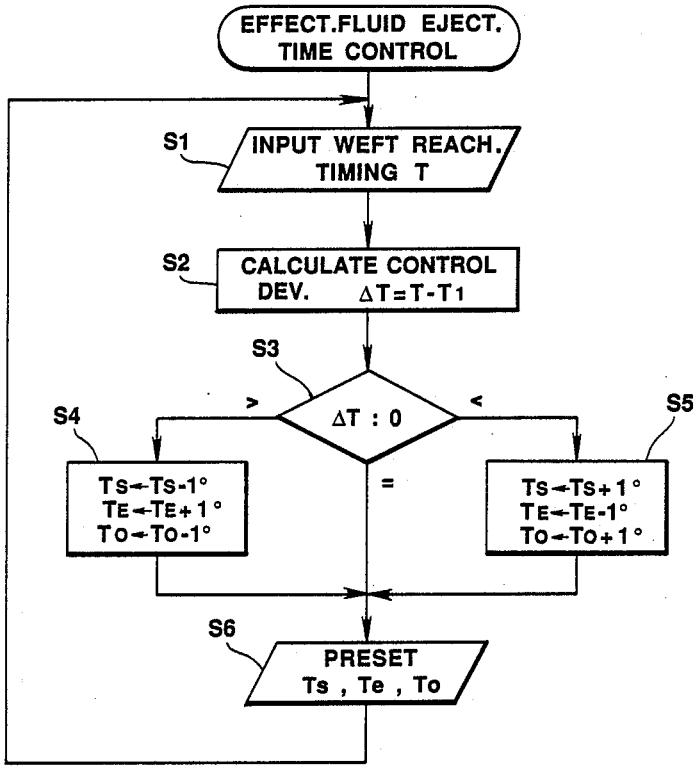
FIG. 2 is a flowchart showing a program of an effective fluid ejection time control used in the weft picking control system of FIG. 1.
Figure 3:
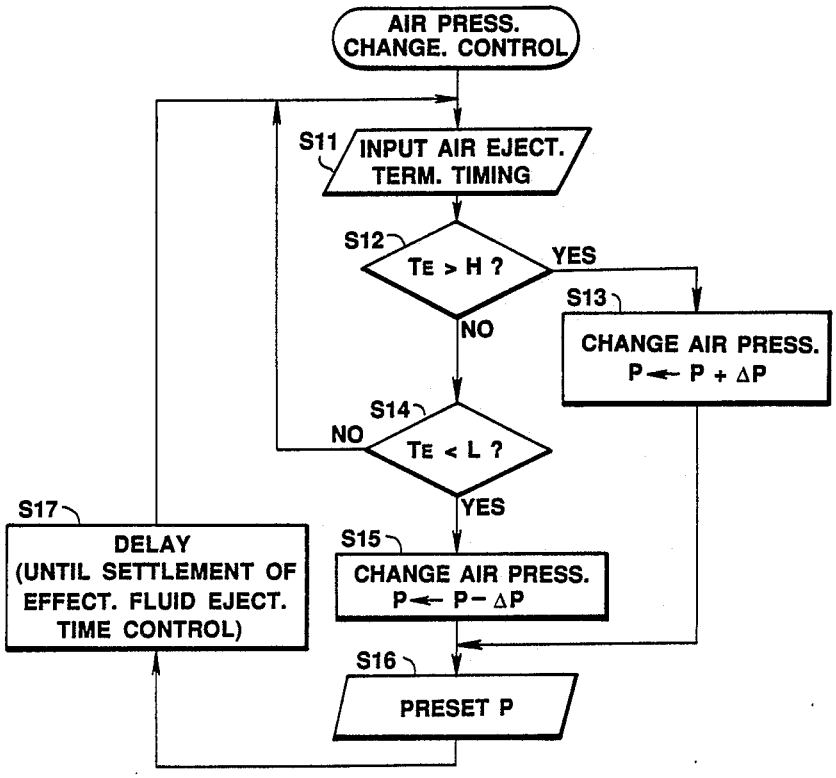
FIG. 3 is a flowchart showing a program of an air pressure changing control used in the weft picking control system of FIG. 1.

Referring now to FIGS. 1 to 3, there is shown a first embodiment of a weft picking control system in accordance with the present invention, incorporated with a weft picking system for a fluid (air) jet loom. The weft picking system is generally constructed and arranged as follows: A weft yarn 2 drawn from a yarn supply member or bobbin (not shown) is inserted into a pipe-shaped weft winding arm 11 of a weft measuring and storing unit 7. The tip end section of the weft winding arm 11 moves or rotates around a drum 10 of the weft measuring and storing unit 7. Accordingly, the weft yarn 2 from the weft winding arm 11 is wound on the drum 10 for the purpose of being measuring and stored as, a predetermined length prior to weft picking. The weft yarn 2 wound on the drum 10 is threaded into a weft inserting nozzle (or main nozzle) 1. The weft inserting nozzle 1 is arranged to eject air jet therefrom in order to project the weft yarn 2 under influence of the air jet. The thus projected weft yarn 2 is inserted or picked into the shed formed in the array of warp yarns (not shown), thereby accomplishing a weft picking or insertion. During this weft picking, the air jet from the weft inserting nozzle 1 may be enhanced and assisted by air jets ejected from a plurality of auxiliary nozzles (not shown) disposed along the insertion path of the weft yarn 2. A weft retaining or measuring pawl 13 is provided to be inserted into and released (withdrawn) from the drum 10 in such a manner as to be engaged with and released from the weft yarn 2 wound on the drum 10. The measuring pawl 13 is adapted to be released from the drum 10 to be disengaged from the weft yarn during weft picking, while inserted into the drum 10 to be engaged with the weft yarn to stop weft picking. Such a weft picking system is well known as disclosed in U.S. Pat. No. 4,378,821 entitled "Weft Detaining Device of Shuttleless Loom". Additionally, a weft storage unit similar to the above-mentioned is disclosed in U.S. Pat. No. 4,766,937 entitled "Weft Storage Device".

The weft picking control system will be discussed in detail hereinafter in connection with the weft picking system.

The weft inserting nozzle 1 is adapted to project the weft yarn 2 under the influence of air jet ejected from the weft inserting nozzle 1. The weft inserting nozzle 1 is supplied with pressurized air from a pressurized air source (not shown) through an air tank 3, an electricity-air pressure proportional valve 4, a surge tank 5 and an electromagnetic valve 6. Accordingly, air pressure to be fed to the weft inserting nozzle 1 is controllable by the electricity-air pressure proportional valve 6. Timing of air (jet) ejection in the weft inserting nozzle 1 is controlled by the electromagnetic valve 6. The air ejection timing includes an air ejection initiation timing at which air (jet) is initiated to be ejected from the weft inserting nozzle 1, and an air ejection termination timing at which air (jet) is terminated to be ejected from the weft inserting nozzle 1.

The weft yarn 2 is drawn from the weft supply member (not shown) and introduced to the weft measuring and storing unit 7 which includes a drum 10 which is relatively rotatably mounted on the tip end section of a hollow rotatable shaft g which is driven to rotate by a rotor 8, so that the drum 10 is maintained stationary even upon rotation of the hollow rotatable shaft g. The weft winding arm 11 is fixedly attached to the hollow rotatable shaft 9 and projects obliquely forward in such a manner that the tip end section thereof is rotatable around the drum 10 under rotation of the rotatable shaft 9. The weft winding arm 11 is hollow and communicates with the hollow portion of the rotatable shaft 9 so that the weft yarn 2 from the weft supply member is passed through the hollows of the rotatable shaft 9 and the weft winding arm 11 and drawn from the tip end section of the weft winding arm 11. The weft retaining or measuring pawl 13 is movably disposed to be inserted into and withdrawn or disengaged from (got out of) a hole (not shown) formed on the peripheral surface of the drum 10 under being driven by a solenoid 12. The weft yarn 2 drawn from the tip end section of the rotating weft winding arm 11 is wound on the drum 10 upon being retained by or engaged with the weft retaining pawl 13, so that a predetermined length of the weft yarn 2 is measured and stored in the weft measuring and storing unit 7. The weft retaining pawl 13 is withdrawn from or taken out of the drum hole at a predetermined pawl withdrawal or disengagement timing (or weft picking initiation timing) so that the weft yarn 2 is projected under the influence of fluid (air) jet ejected from the weft inserting nozzle 1, in which the weft yarn 2 is unwound and drawn from the drum 10.

A system for controlling the above-mentioned air ejection timing in the weft inserting nozzle 1 includes an air ejection timing target value setter 14 which is arranged to be able to preset a target value of the air ejection timing (including the air ejection initiation and termination timings) represented in rotational angle of a main shaft (not shown) of the loom. When the air ejection initiation and termination timings preset in the setter 14 are brought into agreement with corresponding respective rotational angles of the loom main shaft, a comparator 16 outputs a voltage signal (ON or OFF signal) which is transmitted as a driving power through a driver amplifier 17 to the electromagnetic valve 6. The loom main shaft rotational angles are detected by an angle sensor 15.

A system for controlling operation timing of the weft retaining pawl 13 includes a pawl operation timing target value setter 18 which is arranged to be able to preset a target value of operation timing of the weft retaining pawl 13. The weft retaining pawl operation timing includes the above-mentioned pawl withdrawal timing and a pawl insertion timing at which the weft retaining pawl 13 is inserted into the hole of the drum 10 so that the weft yarn 2 is retained by or engaged with the weft retaining pawl 13. The pawl withdrawal and insertion timings are represented in rotational angle of the loom main shaft. When the pawl withdrawal and insertion timing are brought into agreement with predetermined respective loom main shaft rotational angles detected by the angle sensor 15, a comparator 19 outputs a voltage signal (ON or OFF signal) which is transmitted as a driving power through a driver amplifier 20 to the solenoid 12.

A photoelectric sensor 21 is provided in a weft picking path on the counter-weft picking side which is on the opposite side of a weft picking side (in which the weft inserting nozzle is located) with respect to a woven cloth (not shown). The photoelectric sensor 21 is adapted to detect a weft reaching timing (as a weft picking condition) at which the weft yarn 2 projected from the weft inserting nozzle 1 has reached the counter-weft picking side.

The air ejection timing controlling system for the weft inserting nozzle 1 and the operation timing controlling system for the weft retaining pawl 13 include a weft reaching timing target value setter 22 which is adapted to be able to preset a target value of the weft reaching timing (for example, 240°)in a rotational angle of the loom main shaft. A signal representative of the weft reaching timing detected by the photoelectric sensor 21 and a signal representative of the weft reaching timing target value from the weft reaching timing target value setter 22 are input to a comparator 23. The comparator 23 is adapted to compare the weft reaching timing and the weft reaching timing target value and to output a signal representative of a control deviation corresponding to the deviation of them. An air ejection timing and pawl withdrawal timing target value corrector 24 is provided to correct the preset air ejection timing target value and the preset pawl withdrawal timing target value in accordance with the signal representative of this control deviation output from the comparator 23. Accordingly, this corrector 24 is electrically connected to the air ejection timing target value setter 24 and to the pawl operation timing target value setter 18.

In other words, the weft reaching timing (as the weft picking condition) is detected by the photoelectric sensor 21 when the weft yarn 2 has reached the counter-weft picking side. In order to cause this weft reaching timing to coincide with the weft reaching timing target value preset by the weft reaching timing target value setter 22, the target values in the air ejection timing target value setter 14 and the pawl operation timing target value setter 18 are corrected under the action of the comparator 23 and the air ejection timing and pawl withdrawal timing target value corrector 24. Thus, the air ejection initiation and termination timings of the weft inserting nozzle 1 and the pawl withdrawal timing of the weft retaining pawl 13 are controlled, thereby controlling the above-mentioned effective fluid (air) ejection time.

A system for controlling air pressure includes a air pressure target value setter 25 which is adapted to be able to preset a target value of air pressure to be fed to the weft inserting nozzle 1. A digital signal representative of this air pressure target value from the setter 25 is fed to a D/A converter 26 to be converted to an air pressure command voltage which is then impressed to the electricity-air pressure proportional valve 4. The electricity-air pressure proportional valve 4 includes a regulator **4*c* which is adapted to control air pressure from the air tank 3 in response to an output signal from a comparator 4*b* which is adapted to compare the air pressure command voltage and a voltage signal from a pressure sensor 4*a* sensing an air pressure prevailing upstream of the surge tank 5. Thus, the electricity-air pressure proportional valve 4 controls the air pressure to be fed to the weft inserting nozzle 1 at a value proportional to the air pressure command voltage from the D/A converter 26**.

Additionally, a comparator 27 is provided to compare each of the corrected air ejection initiation timing, air ejection termination timing and pawl withdrawal timing from the air ejection timing and pawl withdrawal timing target value corrector 24 with previously set predetermined upper and lower limit values. The comparator 27 is adapted to output a signal representative of the result of this comparison. An air pressure target value corrector 28 is provided to correct the preset air pressure target value in accordance with the signal from the comparator 27. Accordingly, the corrector 28 is electrically connected to the air pressure target value setter 25.

In other words, the detected air ejection initiation timing, air ejection termination timing and pawl withdrawal timing are compared with the above-mentioned predetermined lower and upper limit values. For example, when the ejection timing exceeds the predetermined upper limit value, the target value in the air pressure target value setter 25 is corrected under the action of the comparator 27 and the air pressure target value corrector 28, thereby changing air pressure to be fed to the weft inserting nozzle 1.

Next, a discussion with reference to FIGS. 2 and 3 will be made on control of the effective fluid (air) ejection time depending upon the functions of the comparator 27 and the air ejection timing and pawl withdrawal timing target value corrector 24 and on a control for changing air pressure depending upon the functions of the comparator 27 and the air pressure target value corrector 28.

First the effective fluid (air) ejection time control will be discussed with reference to a flow chart in FIG. 2. In a step S1, the weft reaching timing T is detected upon input of the signal from the photoelectric sensor 21. In a step S2, the control deviation $\Delta T$ ($=T-T_1$) relative to the target value $T_1$ (for example, 240°) of the weft reaching timing is calculated. In a step S3, the control deviation $\Delta T$ is compared with 0 (zero). When $\Delta T>0$ (i.e., the weft reaching timing retards) as a result of the comparison, the flow goes to a step S4.

In the step S4, in order to prolong the effective fluid ejection time, the air ejection initiation timing Ts (the initial value: 90°) is advanced 1°; the air ejection termination timing Te (the initial value: 200°) is retarded 1°; and the pawl withdrawal timing To (the initial value: 120°) is advanced 1°, in accordance with the below-mentioned changing algorithm.

Air ejection initiation timing: $Ts \leftarrow Ts-1°$

Air ejection termination timing: $Te \leftarrow Te+1°$

Pawl withdrawal timing: $To \leftarrow To-1°$

Accordingly, when the flow goes to a step S6, the thus corrected air ejection initiation timing Ts, air ejection termination timing Te and pawl withdrawal timing To for prolonging the effective fluid ejection time are set in the setters 14, 18.

Depending upon the thus set air ejection initiation timing and air ejection termination timing, air jet ejection is made from the weft inserting nozzle 1 so that the time of fluid jet ejection is prolonged, while the weft retaining pawl 13 is withdrawn from or got out of the hole of drum 10 at the advanced timing.

When $\Delta T<0$ (i.e., the weft reaching timing advances) as a result of the comparison in the step S3, the flow goes to a step S5. In the step S5, in order to shorten the effective fluid ejection timing, the air ejection timing Ts is retarded °; the air ejection termination timing Te is advanced 1°; and the pawl withdrawal timing To is retarded 1°, in accordance with the below-mentioned changing algorithm.

Air ejection initiation timing: $Ts \leftarrow Ts+1°$

Air ejection termination timing: $Te \leftarrow Te-1°$

Pawl withdrawal timing: $To \leftarrow To+1°$

Accordingly, when the flow goes to a step S6, the thus corrected air ejection initiation timing Ts, air ejection termination timing Te and pawl withdrawal timing To for shortening the effective fluid ejection time is set in the setters 14, 18.

Depending upon the thus set air ejection initiation timing and air ejection termination timing, air jet ejection is made from the weft inserting nozzle 1 so that the time of fluid jet ejection is shortened, while the weft retaining pawl 13 is withdrawn from or got out of the hole of the drum 10 at the retarded timing.

Next, the air pressure changing control will be discussed with reference to a flowchart in FIG. 3. In a step S11, the air ejection termination timing Te is input. It will be understood that the air ejection initiation timing Ts or the pawl withdrawal timing To may be input in place of the timing Te because the timings Ts, Te, To are changed in relation to each other.

In a step S12, the air ejection termination timing Te is compared with a previously set predetermined upper limit value H. When $Te>H$ as a result of the comparison in the step S12, the flow goes to a step S13. At the step S13, the target value of the air pressure P is increased a predetermined amount $\Delta P$.

Consequently, the flow goes to a step S16 in which the corrected air pressure P is set in the air pressure target value setter 25. Thus, air jet ejection is made from the weft inserting nozzle 1 at the thus increased air pressure.

Thereafter, the flow goes to a step S17, a delay is made by a predetermined time for the purpose of waiting until the effective fluid ejection time control (feedback control) has been settled or completed. In other words, waiting is made until the air ejection timing etc. to meet the target value of the weft reaching timing at the increased air pressure has been set. Thereafter, the flow returns to the step S11.

Thus, an optimum weft picking control is made possible within a region in which such a control by the effective fluid ejection time control is difficult.

When $Te \leqq H$ as a result of the comparison in the step S12, the flow goes to a step S14. In the step S14, comparison is made between the air ejection termination timing Te and a previously set predetermined lower limit value (or a value having a suitable hysteresis relative to the predetermined upper limit value) L. When $Te<L$ as a result of the comparison in step S14, the flow goes to a step S15. In the step S15, the target level of the air pressure P is decreased the predetermined amount $\Delta P$.

Subsequently, the flow goes to the step 16 to set the thus corrected air pressure P in the air pressure target value setter 25. Thus, air jet ejection is made from the weft inserting nozzle 1 at the thus decreased air pressure.

Thereafter, the flow goes to the step S17 in which a delay is made by a predetermined time for the purpose of waiting until the effective fluid ejection time control (feedback control) has been settled or completed. In other words, waiting is made until the air ejection timing etc. to meet the target value of the weft reaching timing at the decreased air pressure has been set. Thereafter, the flow returns to the step S11.

When $Te \geqq L$ as a result of the comparison in the step S14, the flow returns to the step S11.

While all the air ejection initiation timing, the air ejection termination timing and the pawl withdrawal timing have been shown and described as being changed, it will be understood that any one or two of them may be changed for attaining the effect of the present invention.

Figure 4:
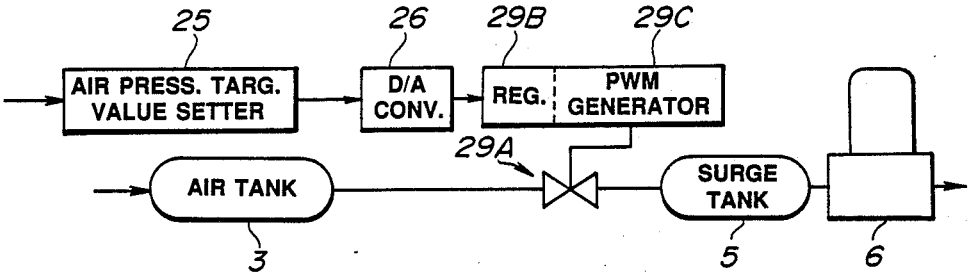
FIG. 4 is a fragmentary diagrammatic illustration of a modified example of the weft picking control system of FIG. 1.

It will be understood that the electricity-air pressure proportional valve 4 may be replaced with a so-called high frequency valve (or duty control valve) 29A as shown in FIG. 4, in which the high frequency valve 29A is controlled through a regulator 29B and a PWM generator 29C thereby improving response in the air pressure changing control.

As will be appreciated from the above, according to the first embodiment weft picking control system, response in control is highly improved by virtue of the effective fluid (air) ejection time control. Additionally, the weft picking control system is so arranged that the control value or parameter for the effective fluid ejection time is compared with the predetermined upper and lower limit values, in which the air pressure to be fed to the weft inserting nozzle is changed when the control value exceeds the predetermined upper and lower limit values. Therefore, a required weft picking condition can be met by changing the air pressure even in a loom operating region in which a control depending upon the effective fluid ejection time is difficult because of the fact that upper and lower limits exist in such a control.

Figure 5:
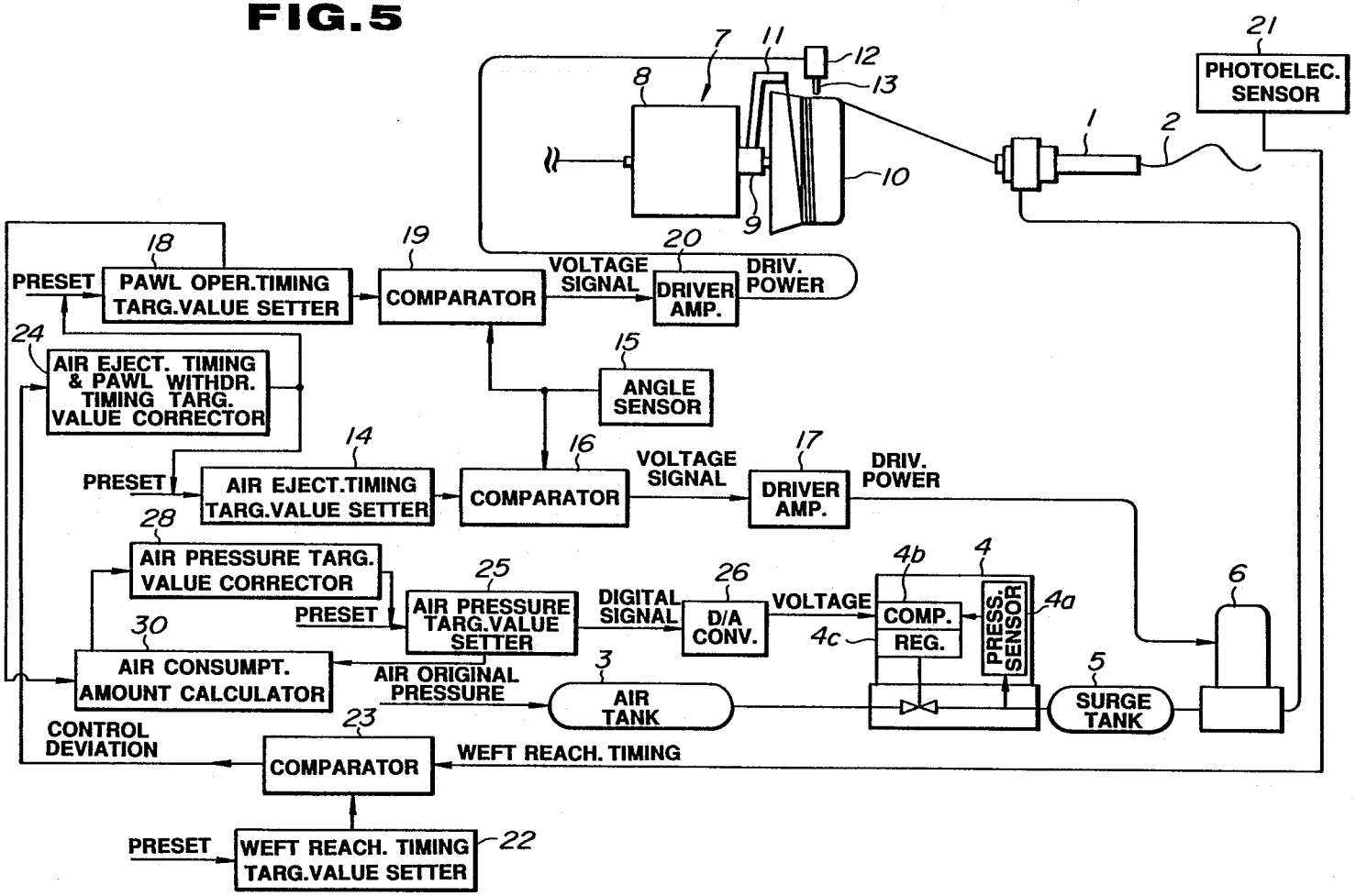
FIG. 5 is a diagrammatic illustration of a second embodiment of the weft picking control system in accordance with the present invention, incorporated with a weft picking system for a fluid jet loom.
Figure 6:
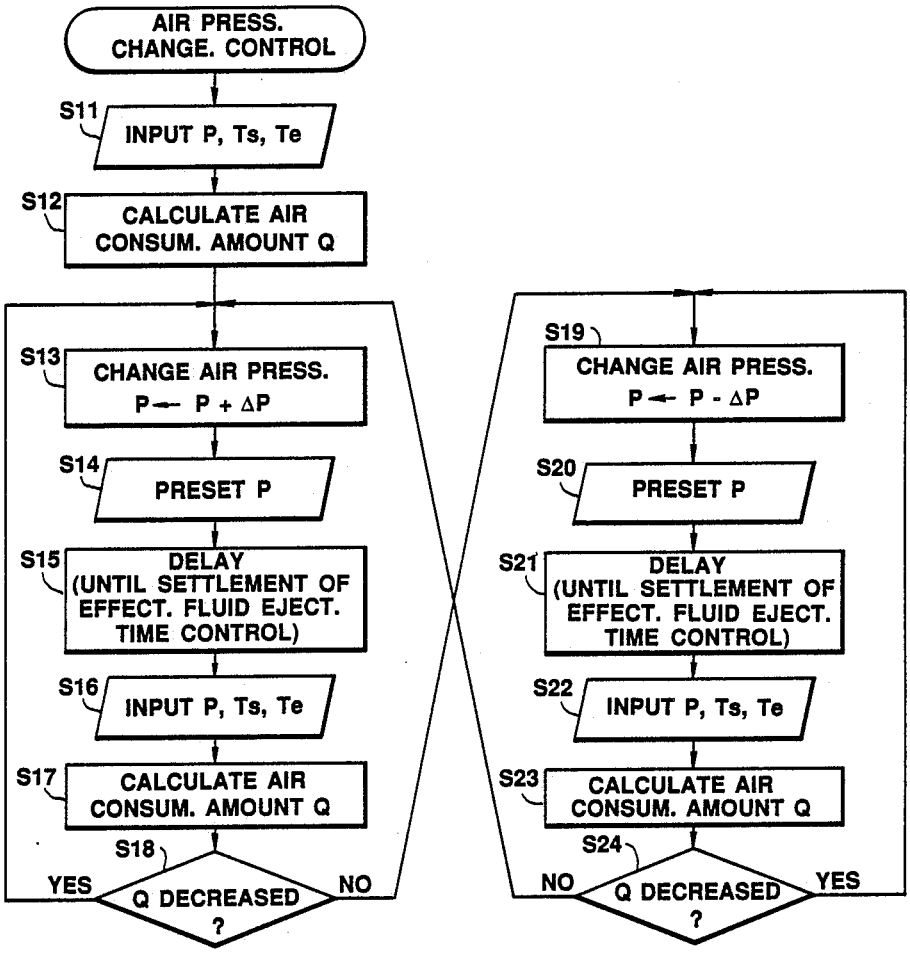
FIG. 6 is a flowchart showing a program of an air pressure changing control used in the weft picking control system of FIG. 2.

FIGS. 5 and 6 illustrate a second embodiment of the weft picking control system in accordance with the present invention, which is similar to the first the embodiment of FIGS. 1 to 3. In this embodiment, an air consumption amount calculator 30 is provided to calculate air consumption (air flow amount) in the weft inserting nozzle 1 in accordance with a signal from the air pressure target value setter 25 and a signal from the air ejection timing target value setter 14. In this embodiment, the air pressure target value corrector 28 is electrically connected to the air pressure target value setter 25. A signal from the air consumption amount calculator 30 is input to the air pressure target value corrector 28. Accordingly, the air consumption amount in the weft inserting nozzle 1 is detected, and the target value in the air pressure target value setter 25 is corrected to decrease the air consumption amount, thus controllably changing the air pressure to be fed to the weft inserting nozzle 1.

In this embodiment, the effective fluid (air) ejection time control is made in the same manner as in the flowchart of FIG. 2. The air pressure changing control is made in a manner of a flowchart in FIG. 6, depending upon the functions of the air consumption amount calculator 30 and the air pressure target value corrector 28.

In a step S11, the present air pressure P, air ejection initiation timing Ts and air ejection termination timing Te are input, in which an average value of them is preferably input. This is common in steps 16 and 22 discussed after. In a step S12, an air consumption amount (air flow amount) Q in the weft inserting nozzle 1 is calculated depending upon the above input in the step S11 and according to the following equation:

$$Q=(K_1\times P+C)\times((Te-Ts)-Tk)\times K_2$$

where $K_1$, $K_2$, C and Tk are respectively constants.

Subconsequently, the procedures of steps S13 to S18 are executed.

In the step S13, the target value of the air pressure P is increased a predetermined amount ΔP. In the step 14, the thus corrected air pressure P is set in the air pressure target value setter 25. Accordingly, air ejection is made from the weft inserting nozzle 1 under the thus set high air pressure. In the step S15, a delay is made for a predetermined time or until the effective fluid ejection time control (feedback control) has been settled or completed. In other words, when the air pressure is increased, the weft reaching timing (to the counter-weft picking side) necessarily advances. In order to compensate for this timing advance, the effective fluid ejection time is shortened thereby to restore the weft reaching timing (to the counter-weft picking side) to an original valve, in which waiting is made until determination of a combination of the air pressure and the effective fluid ejection time to meet the target value of the weft reaching timing (to the counter-weft picking side) at the increased air pressure.

In the step S16, the present air pressure P, air ejection initiation timing Ts, air ejection termination timing Te are input. In the step S17, the air consumption amount (air flow amount) Q in the weft inserting nozzle 1 is calculated depending upon the above input in the step S16. In the step S18, comparison is made between the air consumption amount $Q_1$ (of before being increased and detected at a prior time such as the immediately preceding detection cycle) and the air consumption amount $Q_2$ (of after being increased and detected at a present time) thereby making judgement as to whether the air consumption amount decreases ($Q_2<Q_1$) or not.

In the case of "YES", the air consumption amount is controlled in the direction to decrease, and therefore the procedures in the steps S13 to S18 are repeatedly executed to further try to increase the air pressure, in which control is made to obtain the combination of the air pressure and the effective fluid ejection time to suppress the air consumption amount at the minimum value.

In the case of "NO" as a result of the comparison in the step S18, the procedures in steps S19 to S24 are executed. In the step S19, the target value of the air pressure P is decreased a predetermined amount ΔP. In the step S20, the thus corrected air pressure P is set in the air pressure target value setter 25. Accordingly, air ejection is made from the weft inserting nozzle 1 at the thus decreased air pressure.

In the step S21, a delay is made for a predetermined time or until the effective fluid ejection time (feedback control) has been settled or completed. In other words, when the air pressure is decreased, the weft reaching timing (to the counter-weft picking side) necessarily retards. In order to compensate for this retarded timing, the effective fluid ejection time is prolonged thereby to restore the weft reaching timing (to the counter-weft picking side) to an original value, in which waiting is made until determination of a combination of the air pressure and the effective fluid ejection time to meet the target value of the weft reaching timing (to the counter-weft picking side) at the decreased air pressure.

In the step S22, the present air pressure P, air ejection initiation timing Ts, air ejection termination timing Te are input. In the step S23, the air consumption amount (air flow amount) Q in the weft inserting nozzle 1 is calculated depending upon the above input in the step S22. In the step S24, comparison is made between the air consumption amount $Q_1$ (of before being decreased and detected at a prior time such as the immediately preceding detection cycle) and the air consumption amount $Q_2$ (of after being decreased and detected at a present time) thereby making judgement as to whether the air consumption amount decreases ($Q_2<Q_1$) or not.

In the case of "YES", the air consumption amount is controlled in the direction to decrease, and therefore the procedures at the steps S19 to S24 are repeatedly executed to further try to decrease, in which control is made to obtain the combination of the air pressure and the effective fluid ejection time to suppress the air consumption amount at the minimum value.

In the case of "NO" as a result of the comparison in the step 24, the procedures in the steps S13 to S18 are executed.

While detection of the air consumption amount has been shown and described as being made by calculation from the air pressure and the air ejection timings and according to the predetermined calculation formula, it will be understood that it may be carried out by using an airflow meter such as one of the hot-wire type, which meter may be disposed upstream or downstream of the air tank 3.

Next, a result of an experiment conducted to exhibit advantageous effects of the second embodiment will be discussed. In the case in which the fluid ejection time was so controlled that the timing of completion of weft flying (reaching the counter-weft picking side) is constant (240°), setting the timing of initiation of weft flying (projecting from the weft inserting nozzle) constant (109°), weft insertion from the weft inserting nozzle was carried out at an air pressure of 2.0 kg/m$^2$ (Case A) and an air pressure of 2.5 kg/m$^2$ (Case B), in which the air ejection time and the air consumption amount were measured and listed below.

| | A | B |
|---|---|---|
| Air pressure | 2.0 kg/m$^2$ | 2.5 kg/m$^2$ |
| Ejection time | 60° to 156° (difference: 94°) | 60° to 140° (difference: 80°) |
| Air consumption amount | 20.0 m$^3$/h | 19.6 m$^3$/h |

This experiment exhibits that the above case B is advantageous to decrease the air consumption amount.

As appreciated from the above, according to the second embodiment weft picking control system, air consumption amount is appropriately controlled thereby achieving energy saving.

Figure 7:
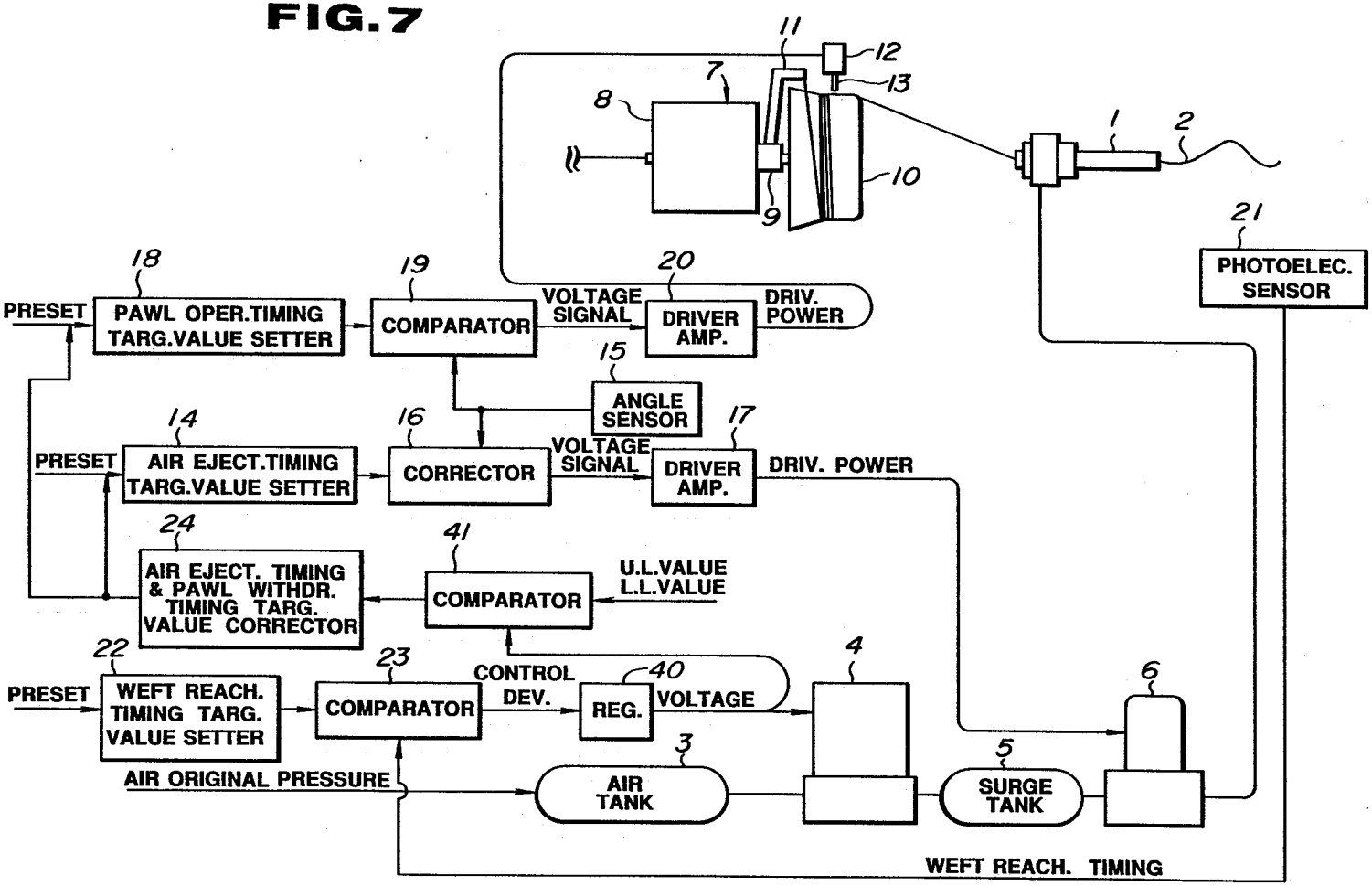
FIG. 7 is a diagrammatic illustration of a third embodiment of the weft picking control system in accordance with the present invention, incorporated with a weft picking system of a fluid jet loom.
Figure 8:
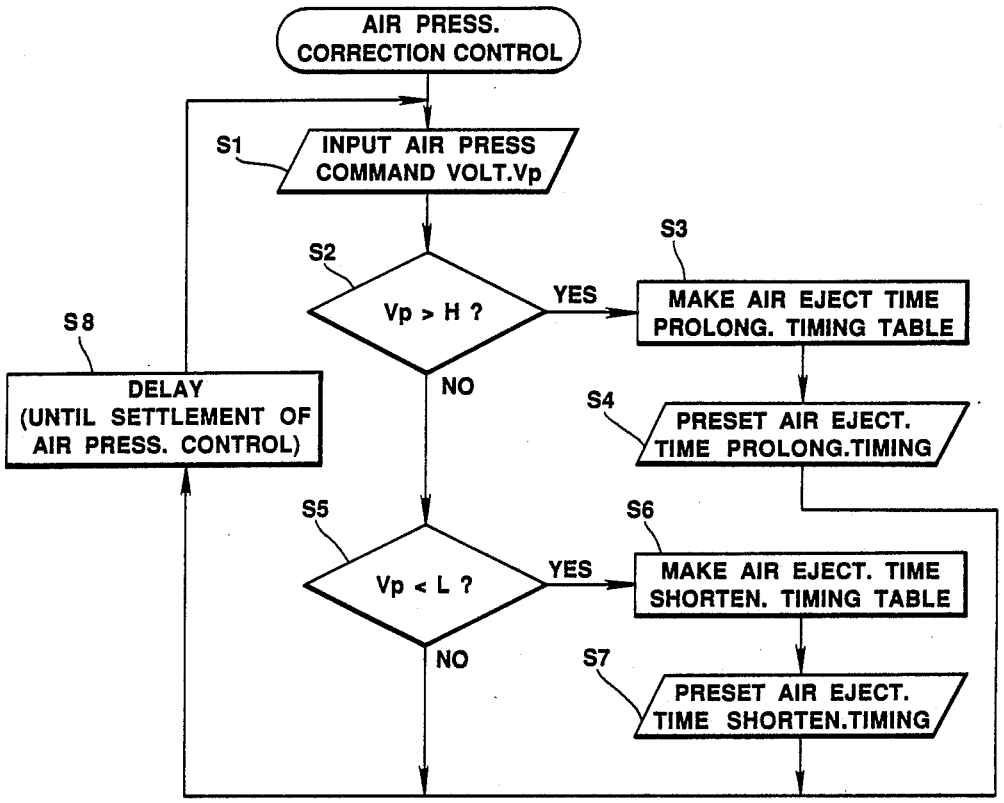
FIG. 8 is a flowchart showing a program of an air ejection time correction control used in the weft picking control system of FIG. 7.

FIGS. 7 and 8 illustrate a third embodiment of the weft picking control system in accordance with the present invention, which is similar to the first embodiment of FIGS. 1 to 3. In this embodiment, a system for controlling the air pressure to be fed to the weft inserting nozzle 1 includes the weft reaching timing target value setter 15, and the comparator 23. A signal representative of the control deviation output from the comparator 23 is output to a regulator 40. The regulator 40 is adapted to generate an air pressure command voltage Vp which is impressed to the electricity-air pressure proportional valve 4. The electricity-air pressure proportional valve 4 is adapted to control the air pressure to be fed to the weft inserting nozzle 1, in proportion to the voltage Vp. In other words, the weft reaching timing (as the weft picking condition) is detected by the photoelectric sensor 21 when the weft yarn 2 has reached the counter-weft picking side. In order to cause this weft reaching timing to coincide with the weft reaching timing target value preset in the weft reaching timing target value setter 22, a feedback control for the air pressure to the weft inserting nozzle 1 is carried out through the comparator 23 and the regulator 40.

A comparator 41 is provided to compare the air pressure command voltage Vp from the regulator 40 with a predetermined upper limit value H (for example, 5 kg/cm$^2$) and to output a voltage signal representative of the comparison result. In accordance with this signal from the comparator 41, the air ejection timing and pawl withdrawal timing target value corrector 24 is operated. The corrector 24 is electrically connected to the air ejection timing target value setter 14 and to the pawl operation timing target value setter 18. Accordingly, the air pressure fed to the weft inserting nozzle 1 is detected and compared with the predetermined upper limit value H. When the air pressure exceeds the predetermined upper limit value H, the air ejection time (or a loom main shaft rotational angle from the air ejection initiation timing to the air ejection termination timing) of the weft inserting nozzle 1 is corrected (prolonged) while correcting the pawl withdrawal timing of the weft retaining pawl 13, thus prolonging the effective fluid (air) ejection time.

Next, such a correction control depending upon the functions of the comparator 41 and the air ejection timing and pawl withdrawal timing target value corrector 24 will be discussed with reference to a flowchart in FIG. 8.

In a step S1, the air pressure command voltage Vp (or a numerical information before D/A conversion) from the regulator 40 is input. In a step S2, the air pressure command voltage Vp is compared with the predetermined upper limit value H. When $Vp > H$ as a result of the comparison, the flow goes to a step S3.

In the step S3, a timing table for prolonging the effective fluid (air) ejection time is made. In other words, assuming that the air ejection initiation timing (Ts), the air ejection termination timing (Te) and the pawl withdrawal timing (To) are respectively 90°, 200° and 120° (in the loom main shaft rotational angle) at the present time (before prolongation of the effective fluid ejection time), the timing table is so made that the air ejection initiation timing, the air ejection termination timing and the pawl withdrawal timing become respectively 85°, 205° and 115° at a timing after the prolongation in accordance with a changing algorithm as shown below.

| | Timing before prolongation | Timing after prolongation | Changing algorithm |
|---|---|---|---|
| Ejection initiation (Ts) | 90° | 85° | Ts − 5° |
| Ejection termination (Te) | 200° | 205° | Te + 5° |
| Pawl withdrawal (To) | 120° | 115° | To − 5° |

Subsequently, in a step S4, timings for prolonging the effective fluid ejection time (i.e., the air ejection timing: 85°, the air ejection termination timing: 205°, and the pawl withdrawal timing: 115°) are set. Then, the flow goes to a step S8. As a result, air ejection is made from the weft inserting nozzle 1 at the air ejection initiation and termination timings corresponding to the prolonged air ejection time while advancing the pawl withdrawal timing of the weft retaining pawl 13, in which the effective fluid (air) ejection time is prolonged. In a step S8, a delay is made for a predetermined time or until the air pressure control has been settled or completed. In other words, waiting is made until determination of an air pressure to meet the target value of the weft reaching timing (to the counter-weft picking side) in the prolonged air ejection time of the weft inserting nozzle 1. Thereafter, the flow returns to the step S1. Thus, an appropriate weft picking control is made possible even in a region in which such a control by air pressure is difficult.

When $Vp \leqq H$ as a result of the comparison in the step S2, the flow goes to a step S5. In the step S5, the air pressure command voltage Vp is compared with a predetermined lower limit value L (or a value having a suitable hystresis relative to the predetermined upper limit value). When $Vp < L$, as a result of the comparison, the flow goes to the step S6.

In the step S6, a timing table for shortening the effective fluid (air) ejection time is made. In other words, assuming that the air ejection initiation timing (Ts), the air ejection termination timing (Te) and the pawl withdrawal timing (To) are respectively 85°, 205° and 115°(in the loom main shaft rotational angle) at the present time (before shortening of the effective fluid ejection time), the timing table is so made that the air ejection initiation timing, the air ejection termination timing and the pawl withdrawal timing become respectively 90°, 200° and 120° at a timing after the shortening in accordance with a changing algorithm.

Subsequently, in a step S7, timings for shortening the effective fluid ejection time (i.e., the air ejection timing: 90°, the air ejection termination timing: 200°, and the pawl withdrawal timing: 120°) are set. Then, the flow goes to a step S8. As a result, air ejection is made from the weft inserting nozzle 1 at the original air ejection initiation and termination timings corresponding to the shortened air ejection time while retarding the pawl withdrawal timing of the weft retaining pawl 13, in which the effective fluid (air) ejection time is shortened. In a step S8, a delay is made for a predetermined time or until the air pressure control has been settled or completed. In other words, waiting is made until determination of an air pressure to meet the target value of the weft reaching timing (to the counter-weft picking side) in the shortened air ejection time of the weft inserting nozzle 1. Thereafter, the flow returns to the step S1.

When $Vp \geqq L$ as a result of the comparison in the step S5, the flow returns through the step S8 to the step S1.

While the air pressure to be fed to the weft inserting nozzle has been shown and described as being detected depending upon the air pressure command voltage impressed to the electricity-air pressure proportional valve 4 in the third embodiment, it will be understood that the air pressure may be actually detected by a known pressure sensor.

Although the correction of the air ejection time of the weft inserting nozzle has been shown and described as being made by changing both the air ejection initiation and termination timings, it will be understood that the correction may be made by changing any one of these timings.

Figure 9:
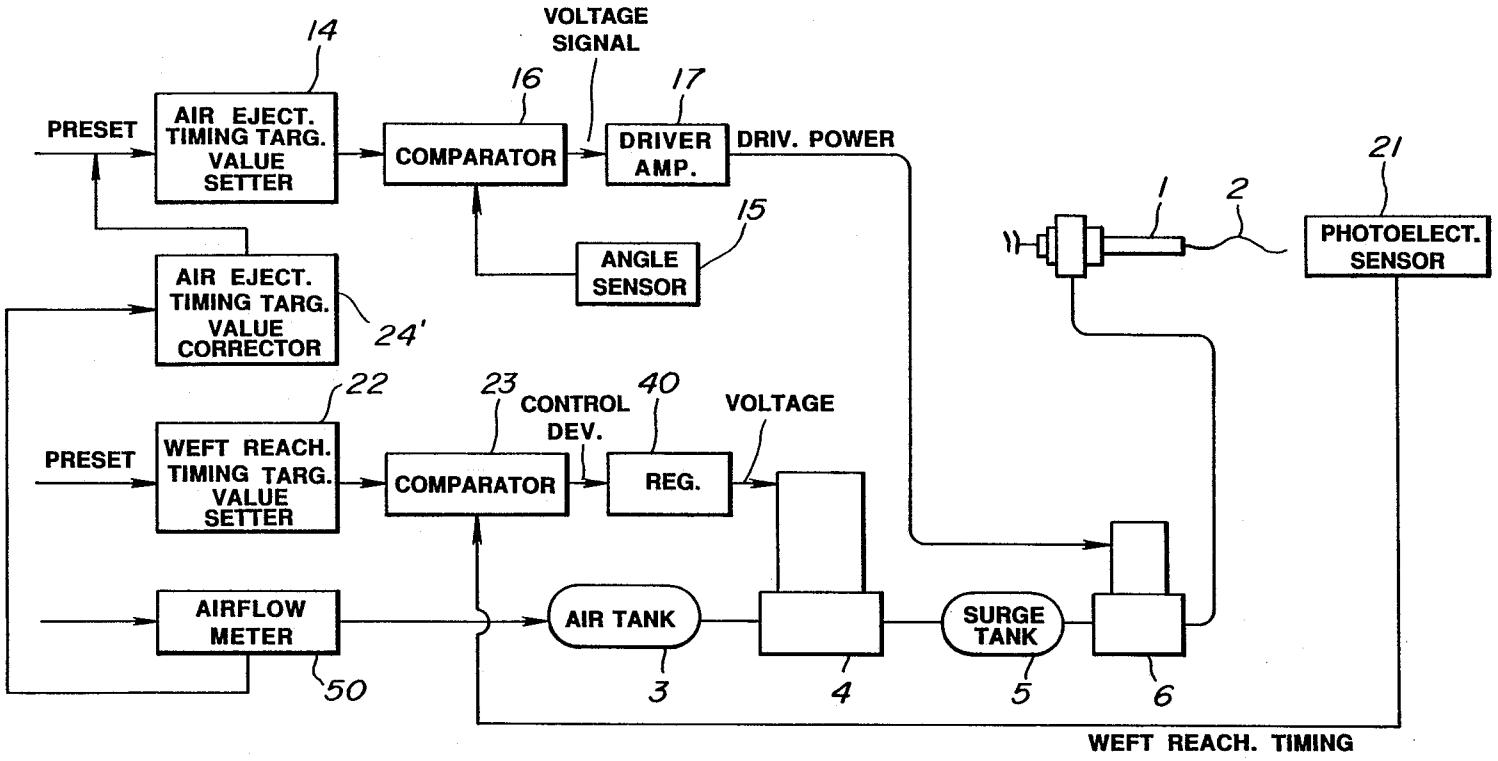
FIG. 9 is a diagrammatic illustration of a fourth embodiment of the weft picking control system in accordance with the present invention, incorporated with a weft picking system of a fluid jet loom.
Figure 10:
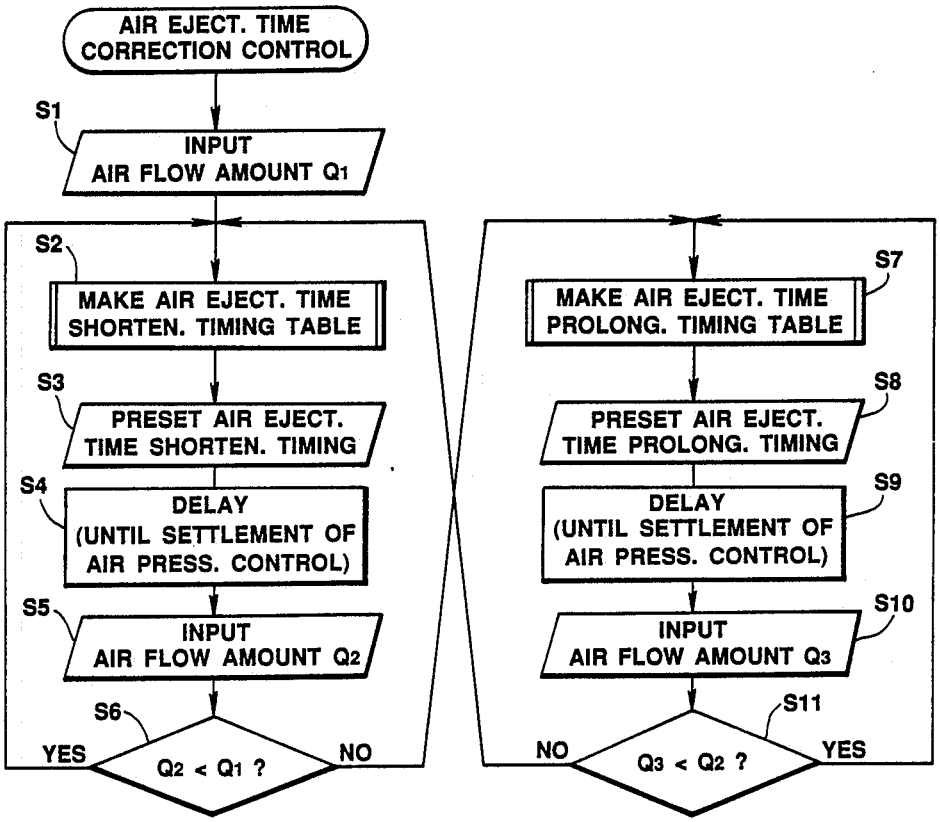
FIG. 10 is a flowchart showing a program of an air ejection time control used in the weft picking system of FIG. 9.

FIGS. 9 and 10 illustrate a fourth embodiment of the weft picking control system in accordance with the present invention, which is similar to the third embodiment of FIGS. 7 and 8. In this embodiment, an airflow meter (for example, of the hot-wire type) 50 is disposed upstream of the air tank 3 in a pressurized air supply line (not identified) through which pressurized air is controllably supplied to the weft inserting nozzle 1. The airflow meter 50 may be disposed downstream of the air tank 3.

The air ejection timing target value corrector 24' is electrically connected to the air ejection timing target value setter 14. An output signal from the airflow meter 50 is supplied to the air ejection timing target value corrector 24'. Accordingly, the air consumption amount (air flow amount) in the weft inserting nozzle 1 is detected, upon which the air ejection time (for example, a loom main shaft rotational angle from the air ejection initiation timing to the air ejection termination timing) of the weft inserting nozzle 1 is correctingly controlled so as to decrease the air consumption amount.

A correction control for the air ejection time will be discussed with reference to a flowchart in FIG. 10.

In a step S1, an air flow amount $Q_1$ detected by the airflow meter 50 is detected.

In the step S2, a timing table for shortening the air ejection time is made. In other words, assuming that the air ejection initiation timing (Tvo) and the air ejection termination timing (Tvc) are respectively 90° and 220° (in the loom main shaft rotational angle) at the present time (before shortening of the ejection time), the timing table is so set that the air ejection initiation timing and the air ejection termination timing become respectively 9220 and 218° at a timing after the shortening in accordance with a changing algorithm as shown below.

| | Timing before shortening | Timing after shortening | Changing algorithm |
|---|---|---|---|
| Ejection initiation (Tvo) | 90° | 92° | Tvo + 2° |
| Ejection termination (Tvc) | 220° | 218° | Tvc − 2° |

Subsequently, in a step S4, timings for shortening the air ejection time (i.e., the air ejection timing: 92°, and the air ejection termination timing: 218°) is set. As a result, air ejection is made from the weft inserting nozzle 1 at the air ejection initiation and termination timings corresponding to the shortened air ejection time.

In the step S4, a delay is made for a predetermined time or until the air ejection time control has been settled or completed. In other words, when the air ejection time is decreased, the weft reaching timing (to the counter-weft picking side) necessarily retards. In order to compensate for this retarded timing, the air pressure is increased, thereby restoring the weft reaching timing (to the counter-weft picking side) to an original value, in which waiting is made until determination of a combination of the air pressure and the air ejection time to meet the target value of the weft reaching timing (to the counter-weft picking side) at the shortened air ejection time.

In a step 5, an air flow amount $Q_2$ detected by the airflow meter 50 is input. In a step S6, comparison is made between the air flow amount $Q_1$ (before the air ejection time shortening and detected in the step S1) and the air flow amount $Q_2$ (after the air ejection time shortening and detected in the step S5), in which judgement is made as to whether the air flow amount is decreased ($Q_2 < Q_1$) or not.

In case of "YES", control is made in the direction to decrease the air consumption amount, and therefore the procedures in the steps S2 to S6 are repeatedly executed to try to further shorten the air ejection time, thus controlling the system to obtain the combination of the air pressure and the air ejection time to suppress the air consumption amount (in the weft inserting nozzle) at the minimum value.

In the case of "NO", the procedures in steps S7 to S11 are executed. In the step S7, a timing table for prolonging the air ejection time is made. In other words, assuming that the air ejection initiation timing and the air ejection termination timing are respectively 92° and 218° (in the loom main shaft rotational angle) at the present time (before prolongation of the air ejection time), the timing table is so set that the air ejection initiation timing and the air ejection termination timing become respectively 90° and 220° at a timing after the prolongation in accordance with a changing algorithm.

Subsequently, in a step S8, timings for prolonging the air ejection time (i.e., the air ejection timing: 90°, and the air ejection termination timing: 220°) are set. As a result, air ejection is made from the weft inserting nozzle 1 at the air ejection initiation and termination timings corresponding to the prolonged air ejection time.

In the step S9, a delay is made for a predetermined time or until the air ejection time control has been settled or completed. In other words, when the air ejection time is increased, the weft reaching timing (to the counter-weft picking side) necessarily advances. In order to compensate for this timing advance, the air pressure is decreased to thereby restore the weft reaching timing (to the acounter-weft picking side) to an original value, in which waiting is made until determination of a combination of the air pressure and the air ejection time to meet the target value of the weft reaching timing (to the counter-weft picking side) at the prolonged air ejection time.

In a step S10, an air flow amount $Q_3$ detected by the airflow meter 50 is input. In a step S11, comparison is made between the air flow amount $Q_2$ (before the air ejection time prolongation and detected in the step S6) and the air flow amount $Q_3$ (after the air ejection time prolongation and detected in the step S10), in which judgement is made as to whether the air flow amount is decreased ($Q_3 < Q_2$) or not. In case of "YES", control is made in the direction to decrease the air consumption amount, and therefore the procedures in the steps S7 to S11 are repeatedly executed to try to further prolong the air ejection time, thus controlling the system to obtain a combination of the air pressure and the air ejection time to suppress the air consumption amount (in the weft inserting nozzle 1) at the minimum value. In the case of "NO", the procedures in the steps S2 to S6 are executed.

Figure 11:
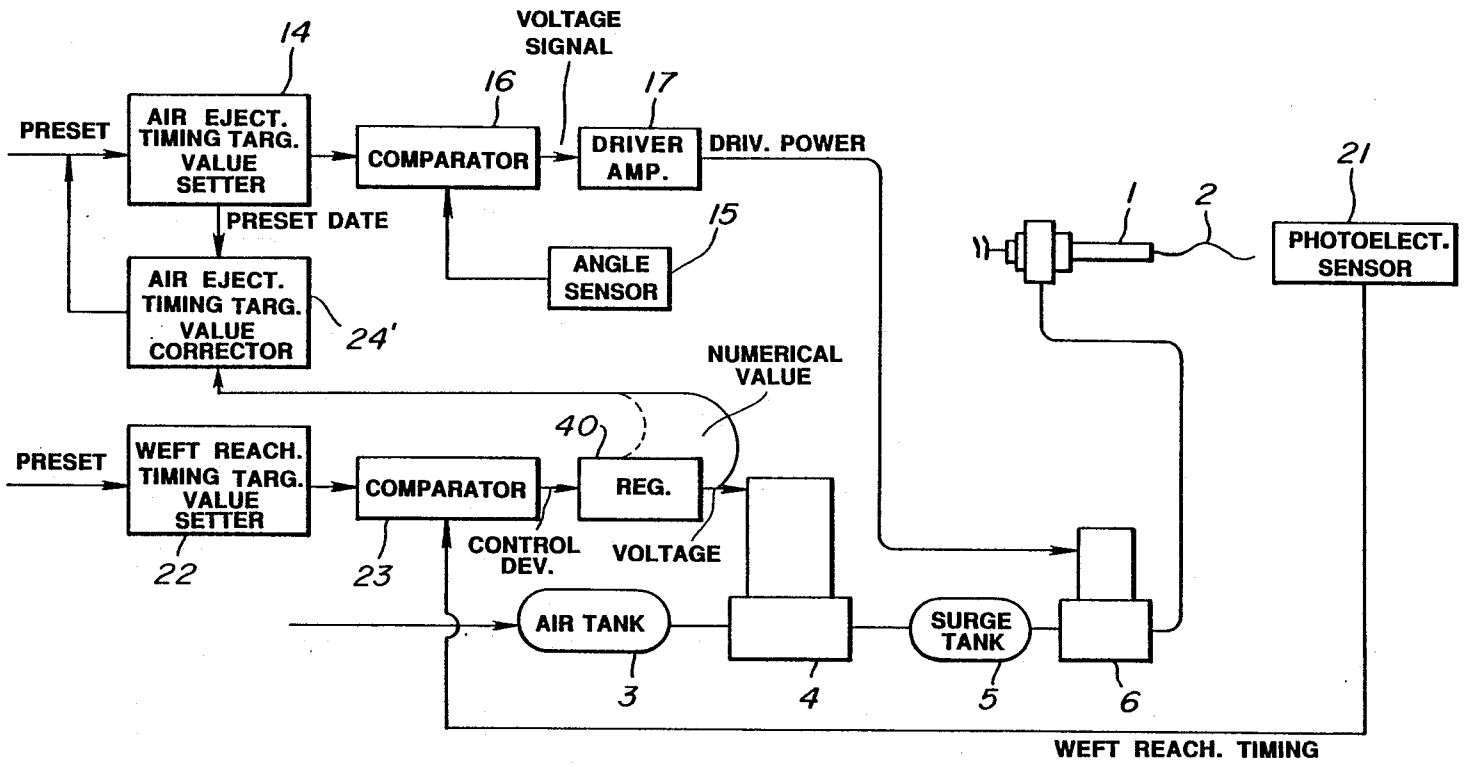
FIG. 11 is a diagrammatic illustration of a modified example of the fourth embodiment weft picking control system of FIG. 9.
Figure 12:
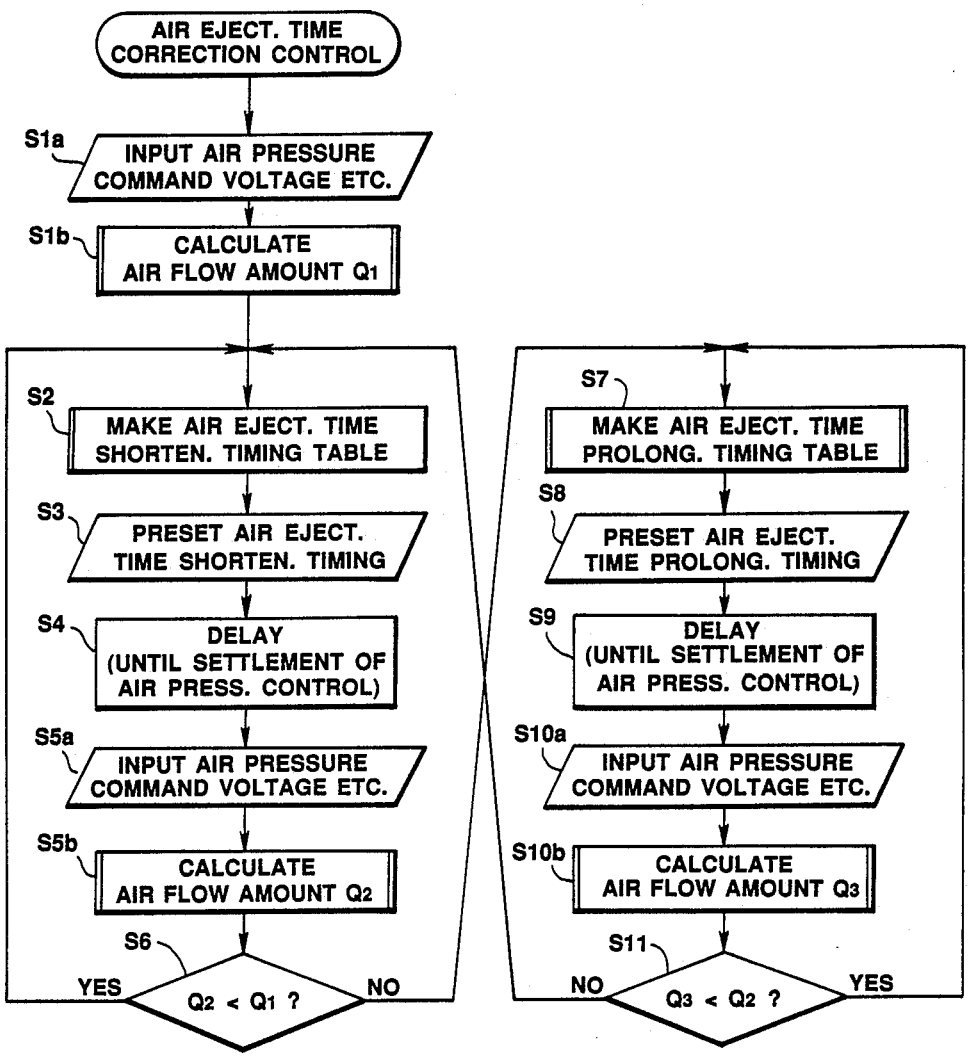
FIG. 12 is a flowchart showing a program of an air ejection time control used in the weft picking control system of FIG. 11.

FIGS. 11 and 12 illustrate a modified example of the fourth embodiment weft picking control system in accordance with the present invention mainly with the exception that the detection of the air consumption amount in the weft inserting nozzle 1 is carried out by a calculation without using the airflow meter 50. More specifically, in this embodiment the airflow meter is omitted. The air pressure command voltage (or the numerical information before D/A conversion) of the regulator 40 and the present value (or preset data) of the air ejection timing target value setter 14 are input to the air ejection timing target value corrector 24'. In this connection, the air consumption amount (air flow amount) in the weft inserting nozzle 1 is calculated by the following equation:

$$Q=(K_1\times Vp+C)\times((Tvc-Tvo)-Tk)\times K_2$$

where Vp is the air pressure command voltage; Tvc is the air ejection termination timing; Tvo is the air pressure initiation timing; $K_1$ and $K_2$ are respectively constant coefficients; and C and Tk are respectively constants.

Accordingly, first the air ejection timing target value corrector 24' is supplied with the air pressure command voltage (or the numerical information before D/A conversion) Vp from the regulator 40 and with the air ejection initiation and termination timings Tvo, Tvc as the present values (the preset data) from the ejection timing target value setter 14, in which the air flow amount Q in the weft inserting nozzle 1 is calculated according to the above-discussed formula. As a result, the air ejection correction control is made in accordance with the thus calculated air flow amount Q.

This air ejection time correction control is shown in a flowchart in FIG. 12 which is similar to that in FIG. 10 with the exception that each of the steps S1, S5 and S10 is divided into a former stage (S1*a*, S5*a* and S10*a*) and a latter stage (S1*b*, S5*b* and S10*b*), in which the air pressure command voltage Vp and the air ejection initiation and termination timings tvo, Tvc are input in each former stage while the air flow amount Q is calculated in each latter stage.

While the air ejection time has been shown and described as being corrected by changing both the air ejection initiation and termination timings, it will be understood that either one of these timings may be changed for the same purpose.

What is claimed is:

1. A weft picking control system for a fluid jet loom including a weft inserting nozzle through which a weft yarn is projected under influence of fluid ejected from the weft inserting nozzle, said system comprising:

means for restraining the weft yarn from being projected in a first condition and for releasing restraint to the weft yarn to allow the weft yarn to be projected in a second condition;

means for detecting a weft picking condition of the weft projected from the weft inserting nozzle;

means for controlling a time for which the fluid ejection is made from the weft inserting nozzle, in accordance with said weft picking condition detected by said detecting means, said time controlling means including means for controlling an effective fluid ejection time in connection with the weft inserting nozzle in accordance with said weft picking condition, said effective fluid ejection time controlling means including means for controlling at least one control parameter defining said effective fluid ejection time, said control parameter controlling means including means for controlling an initiation timing of said effective fluid ejection time, said restraining and releasing means being put into said second condition;

means for controlling fluid pressure to be fed to the weft inserting nozzle, in accordance with said weft picking condition, the fluid ejection from said weft inserting nozzle being made under said fluid pressure;

means for comparing said fluid pressure with a predetermined limit value; and means for operating said fluid ejection time controlling means when said fluid pressure exceeds said predetermined limit value, said fluid operating means including means for operating said initiation timing control means so as to control said initiation timing.

2. A weft picking control system as claimed in claim 1, further comprising means for terminating the fluid ejection from the weft inserting nozzle, wherein said control parameter controlling means includes means for controlling a termination timing of said effective fluid ejection time, said fluid ejection terminating means being operated at said termination timing.

3. A weft picking control system as claimed in claim 1, wherein said fluid jet loom includes a weft measuring and storing unit which has a drum-on which the weft yarn is wound prior to weft picking, and a weft retaining pawl which is engageable with said drum to retain the weft yarn and disengageable from said drum to release the weft yarn so as to allow the weft yarn to be projected from the weft inserting nozzle.

4. A weft picking control system as claimed in claim 3, wherein said control parameter controlling means includes at least one of means for controlling a pawl disengagement (withdrawal) timing for said weft retaining pawl, and means for controlling a fluid ejection termination timing for the weft inserting nozzle.

5. A weft picking control system as claimed in claim 1, wherein said weft picking condition detecting means includes means for detecting a weft reaching timing at which the weft yarn projected from the weft inserting nozzle reaches a counter-weft picking side.

6. A weft picking control system for an air jet loom including weft inserting nozzle which is adapted to project a weft yarn under influence of air ejection therefrom, a measuring and storing unit which has a drum on which the weft yarn is wound prior to weft picking, and a weft retaining pawl which is engageable with said drum to retain the weft yarn and disengageable from said drum to release the weft yarn so as to allow the weft yarn to be projected from the weft inserting nozzle, said system comprising:

means for detecting a weft picking condition of the weft yarn projected from the weft inserting nozzle;

means for controlling an effective air ejection time for weft picking depending upon the fluid ejection of the weft inserting nozzle, in accordance with said weft picking condition detected by said detecting means, said effective air ejection time controlling means including means for controlling at least one of means for controlling a pawl disengagement (withdrawal) timing for the weft retaining pawl, and means for controlling an air ejection termination timing for the weft inserting nozzle;

means for comparing at least one of said pawl disengagement timing and said air ejection termination timing with predetermined upper and lower limit values; and means for changing air pressure to be supplied to the weft inserting nozzle when at least of said pawl disengagement timing and said fluid ejection termination timing exceeds said predetermined upper and lower limit values, the air ejection from the weft inserting nozzle being made under said air pressure.

7. A weft picking control system for a fluid jet loom including a weft inserting nozzle through which a weft yarn is projected under influence of fluid ejected from the weft inserting nozzle, and a weft measuring and storing unit which has a drum on which the weft yarn is wound prior to weft picking, and a weft retaining pawl which is engageable with said drum to retain the weft yarn and disengageable from said drum to release the weft yarn so as to allow the weft yarn to be projected from the weft inserting nozzle, said system comprising:

means for disengaging said weft retaining pawl from said drum;

means for detecting a weft picking condition of the weft yarn projected from the weft inserting nozzle;

means for controlling a time for which the fluid ejection is made from the weft inserting nozzle, in accordance with said weft picking condition detected by said detecting means, said time controlling means including means for controlling an effective fluid ejection time in connection with the weft inserting nozzle in accordance with said weft picking condition, said effective fluid ejection time controlling means including means for controlling at least one control parameter defining said effective fluid ejection time, said control parameter controlling means including means for controlling an initiation timing of said effective fluid ejection time, said weft retaining pawl disengaging means being operated to disengage said weft retaining pawl at said initiation timing;

means for controlling fluid pressure to be fed to the weft inserting nozzle, in accordance with said weft picking condition, the fluid ejection from said weft inserting nozzle being made under said fluid pressure;

means for comparing said fluid pressure with a predetermined limit value; and means for operating said fluid ejection time controlling means when said fluid pressure exceeds said predetermined limit value, said operating means including means for operating said initiation timing control means so as to control said initiation timing.

8. A weft picking control system for a fluid jet loom including a weft inserting nozzle through which a weft yarn is projected under influence of fluid ejected from the weft inserting nozzle, said system comprising:

means from restraining the weft yarn from being projected in a first condition and a for releasing restraint to the weft yarn to allow the weft yarn to be projected in a second condition;

means for detecting a weft picking condition of the weft projected from the weft inserting nozzle;

means for controlling a time for which the fluid ejection is made from the weft inserting nozzle, in accordance with said weft picking condition detected by said detecting means, wherein said time controlling means includes means for controlling an effective fluid ejection time in connection with the weft inserting nozzle in accordance with said weft picking condition, said effective fluid ejection time controlling means including means for controlling at least one control parameter defining said effective fluid ejection time, said control parameter controlling an initiation timing of said effective fluid ejection time, said restraining and releasing means being put into said second condition;

means for controlling fluid pressure to be fed to the weft inserting nozzle, in accordance with said weft picking condition, the fluid ejection from said weft inserting nozzle being made under said fluid pressure;

means for comparing at least one of said control parameters with at lest one predetermined limit value; and means for operating said fluid ejection time controlling means when said at least one control parameter surpasses said predetermined limit value, said fluid operating means including means for operating said initiation timing control means so as to control said initiation timing.

9. A weft picking control system as claimed in claim 8, wherein said at least one limit value comprise upper and lower predetermined limit values; and further comprising means for changing fluid pressure to the weft inserting nozzle when said at least one control parameter exceeds either one of said upper and lower limit values, the fluid ejection from the weft inserting nozzle being made under said fluid pressure.

10. A weft picking control system as claimed in claim 8, further comprising means for terminating the fluid ejection from the weft inserting nozzle, wherein said control parameter controlling means includes means for controlling a termination timing of said effective fluid ejection time, said fluid ejection terminating means being operated at said termination timing.

11. A weft picking control system as claimed in claim 10, wherein said comparing means includes means for comparing at least one of said restraining means operating timing and said fluid ejection terminating means operating timing, with said predetermined upper and lower limit values.

12. A weft picking system as claimed in claim 8, wherein said comparing means includes means for comparing at least one of said pawl disengagement timing and said fluid ejection termination timing with predetermined upper and lower limit values.

13. A weft picking control system as claimed in claim 8, wherein said control parameter controlling means includes a fluid ejection initiation timing for the weft inserting nozzle.

14. A weft picking control system for a fluid jet loom including a weft inserting nozzle through which a weft yarn is projected under influence of fluid ejected from the weft inserting nozzle, said system comprising:

means for detecting a weft picking condition of the weft projected from the weft inserting nozzle;

means for controlling fluid pressure to be fed to the weft inserting nozzle, in accordance with said weft picking condition, the fluid ejection from said weft inserting nozzle being made under said fluid pressure;

means for controlling a time for which the fluid ejection is made from the weft inserting nozzle, in accordance with said weft picking condition detected by said detecting means;

means for detecting a fluid flow amount in the fluid ejection of said weft inserting nozzle; and means for changing said fluid pressure to be fed to the weft inserting nozzle so as to decrease said fluid flow amount, in accordance with said detected fluid flow amount.

15. A weft picking control system as claimed in claim 14, wherein said time controlling means includes means for controlling an effective fluid ejection time in connection with the weft inserting nozzle in accordance with said weft picking condition, said effective fluid ejection time controlling means including means for controlling at least one control parameter defining said effective fluid ejection time, said control parameter controlling an initiation timing of said effective fluid ejection time.

16. A weft picking control system as claimed in claim 15, wherein said fluid flow amount detecting means includes means for calculating said fluid flow amount in accordance with said at least one control parameter.

* * * * *